US010394151B2

(12) United States Patent
Tasaki et al.

(10) Patent No.: US 10,394,151 B2
(45) Date of Patent: Aug. 27, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Mona Tasaki, Kanagawa (JP); Sakon Takahashi, Kanagawa (JP); Moegi Iguchi, Kanagawa (JP); Yutaka Saito, Kanagawa (JP); Soutaro Kakehi, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/979,442

(22) Filed: May 14, 2018

(65) Prior Publication Data

US 2019/0033735 A1 Jan. 31, 2019

(30) Foreign Application Priority Data

Jul. 28, 2017 (JP) ..... 2017-147246

(51) Int. Cl.
*G03G 9/097* (2006.01)
*G03G 9/08* (2006.01)

(52) U.S. Cl.
CPC ..... *G03G 9/09708* (2013.01); *G03G 9/0819* (2013.01); *G03G 9/09716* (2013.01); *G03G 9/09725* (2013.01)

(58) Field of Classification Search
CPC ..... G03G 9/09708; G03G 9/09725; G03G 9/09716; G03G 9/0819
See application file for complete search history.

(56) References Cited

U.S. PATENT DOCUMENTS 7,135,263 B2 11/2006 Kawakami et al.
10,168,630 B2 * 1/2019 Uchino ..... G03G 9/0825
2005/0058926 A1 3/2005 Kawakami et al.
2010/0239971 A1 * 9/2010 Moriya ..... G03G 9/081 430/108.6
2015/0059818 A1 3/2015 Koumoto et al.

FOREIGN PATENT DOCUMENTS

JP 2003277054 A * 10/2003
JP 2007033485 2/2007
JP 2008058463 3/2008
JP 2010044113 2/2010
JP 4594010 12/2010
JP 2015137208 7/2015
JP 2015184463 10/2015
JP 2018020919 A * 2/2018

OTHER PUBLICATIONS

English language machine translation of JP 2018-020919 (Feb. 2018).*
English language machine translation of JPO application 2017-052518 (filed Mar. 17, 2017).*
"Search Report of Europe Counterpart Application", dated Nov. 16, 2018, p. 1-p. 5.

* cited by examiner

*Primary Examiner* — Christopher D Rodee
(74) *Attorney, Agent, or Firm* — JCIPRNET

(57) ABSTRACT

An electrostatic charge image developing toner includes a toner particle; a strontium titanate particle that is externally added to the toner particle and that is doped with a metal element having an electronegativity of 1.3 or less; and a silica particle that is externally added to the toner particle, in which in a case where a detected peak intensity of a metal element having an electronegativity of 1.3 or less is Me-R, a detected peak intensity of strontium is Sr—R, a detected peak intensity of silicon is Si—R, and an element proportion of strontium is Sr—P, Conditions (1) to (3) are satisfied, $$0.08\ \text{kcps} \leq \text{Me-R} \leq 10\ \text{kcps}, \quad (1)$$

$$0.1\% \leq \text{Sr—P} \leq 3.0\%, \text{ and} \quad (2)$$

$$0.15 \leq \text{Sr—R/Si—R} \leq 12. \quad (3)$$

18 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2017-147246 filed on Jul. 28, 2017.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner including: a toner particle; a strontium titanate particle that is externally added to the toner particle and that is doped with a metal element having an electronegativity of 1.3 or less; and a silica particle that is externally added to the toner particle, in which in a case where a detected peak intensity of the metal element having an electronegativity of 1.3 or less which is obtained by an X-ray fluorescence element analysis method (XRF) is Me-R, a detected peak intensity of strontium which is obtained by an X-ray fluorescence element analysis method (XRF) is Sr—R, a detected peak intensity of silicon which is obtained by an X-ray fluorescence element analysis method (XRF) is Si—R, and an element proportion of strontium obtained by an X-ray photoelectron spectroscopy method (XPS) is Sr—P, Conditions (1) to (3) are satisfied, $$0.08\ \text{kcps} \leq \text{Me-R} \leq 10\ \text{kcps}, \quad (1)$$

$$0.1\% \leq \text{Sr—P} \leq 3.0\%, \text{ and} \quad (2)$$

$$0.15 \leq \text{Sr—R/Si—R} \leq 12. \quad (3)$$

BRIEF DESCRIPTION OF THE DRAWINGS

Exemplary embodiment(s) of the present invention will be described in detail based on the following figures, wherein.

DETAILED DESCRIPTION

Figure 1:
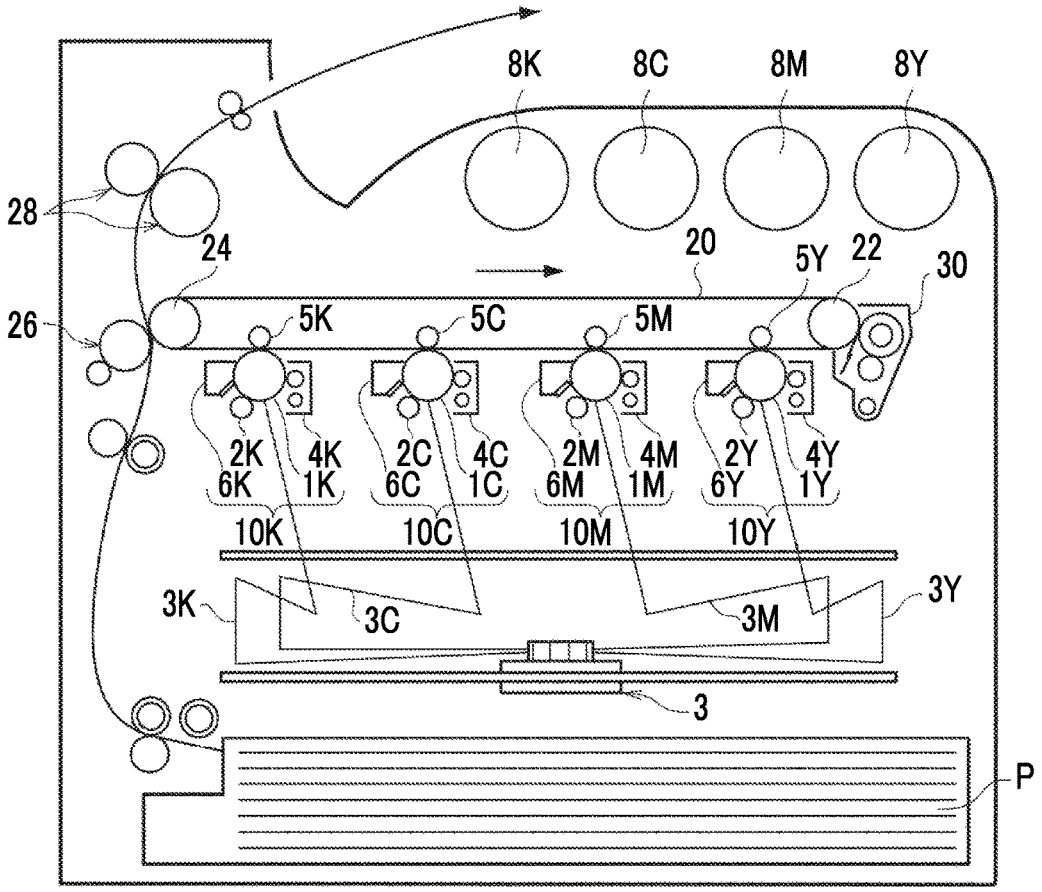
FIG. 1 is a schematic view illustrating a configuration of an image forming device according to this exemplary embodiment.

Hereinafter, exemplary embodiments of the present invention are described. These descriptions and examples exemplify the exemplary embodiments and do not limit the scope of the invention.

In the present disclosure, in a case of referring to the amount of each component in the composition, in a case where there are plural kinds of substances corresponding to each component in the composition, unless described otherwise, the amount means a total amount of plural substances.

In the present specification, the numerical range expressed by using "to" means a range including numerical values described before and after "to" as a lower limit value and an upper limit value.

In this disclosure, an "electrostatic charge image developing toner" is simply referred to a toner, and an "electrostatic charge image developer" is simply referred to as a "developing agent".

Electrostatic Charge Image Developing Toner

Subsequently, the electrostatic charge image developing toner according to this exemplary embodiment is described.

The toner according to this exemplary embodiment includes a toner particle, a strontium titanate particle (hereinafter, simply referred to as a "specific strontium titanate particle") that is externally added to the toner particle and that is doped with a metal element having an electronegativity of 1.3 or less, and a silica particle externally added to the toner particle. That is, the toner according to this exemplary embodiment includes the silica particle and the specific strontium titanate particle, as external additives, in addition to the toner particle. Hereinafter, a metal element that is doped to the specific strontium titanate particle and that has an electronegativity of 1.3 or less is referred to as a "dopant".

In the toner according to this exemplary embodiment, in a case where the detected peak intensity of a metal element in which an electronegativity obtained by an X-ray fluorescence element analysis method (XRF) is 1.3 or less is set as Me-R, the detected peak intensity of strontium is Sr—R, the detected peak intensity of silicon is Si—R, and an element proportion of strontium obtained by an X-ray photoelectron spectroscopy method (XPS) is Sr—P, Conditions (1) to (3) are satisfied.

$$0.08\ \text{kcps} \leq \text{Me-R} \leq 10\ \text{kcps} \quad (1)$$

$$0.1\% \leq \text{Sr—P} \leq 3.0\% \quad (2)$$

$$0.15 \leq \text{Sr—R/Si—R} \leq 12 \quad (3)$$

In a case where the output of a low image density (for example, image density of 1%) is continuously performed under low temperature and low humidity (for example, 10° C. and 15% RH), the surface of a highly stirred toner particle has a high charge density. In a case where the output of a high image density (for example, image density of 80%) is performed such that a large amount of uncharged toner is added to the toner in this state, electrostatic aggregation occurs between the toner particles, and color points are generated.

Here, the "color point" is a phenomenon in which a region with high density is locally generated on the image, and appears as a spot.

Particularly, a silica particle is known as an external additive for toner, but these silica particles may provide negative chargeability to a toner particle and have high triboelectric charging properties, and thus, in a case where these silica particles are used as external additives, the negative chargeability of the surface of the toner particle is easily increased. In a case where the toner particles to which silica particles are externally added are highly stirred as described above, the surfaces have the higher charge density, and electrostatic aggregation between the toner particles easily occurs.

Therefore, for the purpose of suppressing the increase of the negative chargeability of the toner particles, there is a method of using strontium titanate particles having a lower negative chargeability than titanium oxide as an external additive, but the method is still insufficient in view of improvement of electrostatic aggregation between toner particles.

Then, the present inventors reviewed the external additives and have found that, in the toner using strontium titanate particles doped with a metal element having an electronegativity of 1.3 or less together with silica particles as an external additive, amounts and ratios of a metal element (Me) having an electronegativity of 1.3 or less, strontium (Sr), and silicon (Si), which are present inside and on the surface of the toner are optimized such that electrostatic aggregation between toner particles may be suppressed. The present inventors further reviewed and have found that the suppression of the of electrostatic aggregation between toner particles may be achieved by causing amounts and ratios of a metal element (Me) having an electronegativity of 1.3 or less, strontium (Sr), and silicon (Si), which are present inside and on the surface of the toner, to satisfy Conditions (1) to (3).

Negative chargeability and electronegativity are correlated with each other, and there is a tendency in that, as the electronegativity becomes smaller, the negative chargeability becomes lower. As described above, in a case where the conditions (1) to (3) is satisfied by using strontium titanate particles doped with a metal element having electronegativity of 1.3 or less as an external additive, even in a case where a silica particle is used as an external additive, the negative chargeability of the surface of the toner particles may be suppressed from increasing, and thus electrostatic aggregation between the toner particles is suppressed.

As a result, in the toner according to an aspect of the invention, it is assumed that generation of a color point is suppressed.

Conditions (1) to (3)

Conditions (1) to (3) according to this exemplary embodiment are described.

In the toner according to this exemplary embodiment, in a case where the detected peak intensity of a metal element in which an electronegativity obtained by an X-ray fluorescence element analysis method (XRF) is 1.3 or less is set as Me-R, the detected peak intensity of strontium is Sr—R, the detected peak intensity of silicon is Si—R, and an element proportion of strontium obtained by an X-ray photoelectron spectroscopy method (XPS) is Sr—P, Conditions (1) to (3) are satisfied.

$$0.08\ \text{kcps} \leq \text{Me-R} \leq 10\ \text{kcps} \quad (1)$$

$$0.1\% \leq \text{Sr—P} \leq 3.0\% \quad (2)$$

$$0.15 \leq \text{Sr—R/Si—R} \leq 12 \quad (3)$$

In the X-ray fluorescence element analysis method (XRF), the amount of elements which are present inside and on the surface of the toner obtained by externally adding an external additive to the toner particles is determined.

In the X-ray photoelectron spectroscopy method (XPS), a proportion of the elements that are present on the surface of the toner in which an external additive is externally added to the toner particle is obtained.

Me-R provided in Condition (1) indicates an abundance amount of the metal element having an electronegativity of 1.3 or less inside and on the surface of the toner, and, in a case where the condition of 0.08 kcps≤Me-R≤10 kcps is satisfied, electrostatic aggregation between toner particles is suppressed.

It is assumed that this is because Me-R is derived from a metal element which is a dopant in specific strontium titanate particles, satisfying the condition (1) reflects that the specific strontium titanate particles are externally added, in this case, an increase in the negative chargeability of the surface of the toner particles may be effectively suppressed, and as a result, electrostatic aggregation between the toner particles is suppressed.

In a case where Me-R is less than the lower limit value, the negative chargeability of the surface of the toner particles is hardly suppressed from increasing, and thus the electrostatic aggregation between the toner particles is hardly suppressed. In a case where Me-R is more than the upper limit value, the external addition amount of the strontium titanate particles increases, the strontium titanate particles are also negatively chargeable, and thus the negative chargeability of the surface of the toner particles is increased, such that electrostatic aggregation between toner particles is hardly suppressed.

Me-R in this exemplary embodiment preferably satisfies Condition (1-1) below, for example.

$$0.12\ \text{kcps} \leq \text{Me-R} \leq 4\ \text{kcps} \quad (1\text{-}1)$$

Me-R in Condition (1) is controlled by an amount of the dopant in the specific strontium titanate particle and an amount (externally added amount) of the specific strontium titanate particle, and the like.

Sr—P provided in Condition (2) represents an abundance proportion of strontium on the toner surface and may be controlled by the amount (externally added amount) and the particle diameter of the specific strontium titanate particles externally added to the toner particles, the amount (externally added amount) and the particle diameter of the silica particles or other particles externally added to the toner particles, and the like.

In a case where this satisfies the condition of 0.1%≤Sr—P≤2.2%, Condition (1) is easily satisfied.

Sr—P in this exemplary embodiment preferably satisfies Condition (2-1) below, for example.

$$0.3\% \leq \text{Sr—P} \leq 1.0\% \quad (2\text{-}1)$$

Sr—R in Condition (3) indicates an abundance amount of strontium inside or on the surface of the toner and may be controlled by an amount (externally added amount) and a particle diameter of the specific strontium titanate particle externally added to the toner particle, and the like.

Sr—R in Condition (3) indicates an abundance amount of silicon inside or on the surface of the toner and may be controlled by an amount (externally added amount) of the silica particle externally added to the toner particle, and the like.

It is assumed that, in a case where the condition of 0.15≤Sr—R/Si—R≤12 is satisfied, Condition (1) is easily satisfied, externally added amounts of the silica particles and the specific strontium titanate particles are balanced, and the external additive effect of the specific strontium titanate particles is exhibited, such that the negative chargeability of the surface of the toner particles may be effectively suppressed from increasing.

In this exemplary embodiment, the relationship between Sr—R and Si—R preferably satisfies Condition (3-1), for example.

$$0.4\ \text{Sr—R/Si—R} \leq 5 \quad (3\text{-}1)$$

Condition (4)

It is preferable that the toner according to this exemplary embodiment satisfies Condition (4), for example, in a case where an element proportion of a metal element having an electronegativity of 1.3 or less which is obtained by the X-ray photoelectron spectroscopy method (XPS) is Me-P.

$$0.2\% \leq \text{Me-P} \leq 0.8\% \quad (4)$$

Me-P in Condition (4) indicates an abundance proportion of a metal element having an electronegativity of 1.3 or less on the surface of the toner, and may be controlled by an amount of the dopant in the specific strontium titanate particle externally added to the toner particle and an amount (externally added amount) of the specific strontium titanate particle, and the like.

In a case where this satisfies the condition of 0.2%≤Me-P≤0.8%, Condition (1) is easily satisfied.

Me-P in this exemplary embodiment preferably satisfies Condition (4-1) below, for example.

$$0.07\% \leq \text{Me-P} \leq 0.35\% \quad (4\text{-}1)$$

According to this exemplary embodiment, the X-ray fluorescence element analysis method (XRF) is performed in the following method.

First, 6 g of the toner as a measurement sample is subjected to compression molding in a disk shape with a diameter of 5 cm at a load of 10 tf, a loading speed of 3, and a loading time of 60 seconds, by using a compression molding machine manufactured by Maekawa Testing Machine MGF. Co., Ltd.

The obtained disk-shaped compression molded product is subjected to elementary analysis according to an element to be analyzed in a measurement area of 30 mmφ by using an X-ray fluorescent analyzer (XRF 1500, manufactured by Shimadzu Corporation).

Here, the element to be analyzed is silicon (Si), strontium (Sr), and a metal element (Me) having an electronegativity of 1.3 or less, qualification of the elements is performed by using SQX software manufactured by Rigaku Corporation, and the detected peak intensity of the elements is employed as the detected amount (kcps).

In the case of silicon (Si), under the conditions of a voltage of 30 kV, a current of 100 mA, a filter of F—Be, a slit of S4, and spectroscopic crystal RX4, a detector of PC, and PHA of 100-300, a peak wavelength of silicon (Si) is set as 144.78 deg, a fixed point measurement with a measurement time of 40 seconds is performed. 141.78 deg (start) and 148.00 deg (end) are set as background wavelengths, from the result obtained by performing measurement for every 10 seconds, and the difference between a peak value and a background is calculated, so as to derive a detection amount (kcps).

In a case of strontium (Sr) and a metal element (Me) having an electronegativity of 1.3 or less, under the conditions of a voltage of 60 kV, a current of 50 mA, a filter of F—Al, a slit of S2, and spectroscopic crystal LiF, a detector of SC, and PHA of 100-300, measurement is performed from 5 deg to 90 deg, so as to confirm the detection peak. Amounts of detected elements are independently measured again, with respect to KA values of strontium (Sr) and a metal element (Me) having an electronegativity of 1.3 or less, which are indicated by SQX software and are detected. The wavelength of the detected peak value and ±4 deg of both ends of the peak value are selected as the background, the peak wavelength is measured under the same conditions as above for the measurement time of 40 seconds, and the wavelengths at both ends of the background are is measured at 10 seconds each, so as to derive a detected amount of each element (kcps).

In a case where there are plural metal elements having an electronegativity of 1.3 or less, Me-R is a sum of plural detected peak intensities (detected amounts).

According to this exemplary embodiment, X-ray photoelectron spectroscopy method (XPS) is performed in the following method.

That is, the toner as a measurement sample is subjected to element analysis at an acceleration voltage of 10 kV and an emission current of 20 mA by using an X-ray photoelectron spectrometer (JPS-9000 MX manufactured by JEOL Ltd.) and using an MgKa ray as an X-ray source.

Here, the elements to be analyzed are carbon (C), oxygen (O), silicon (Si), titanium (Ti), strontium (Sr) and a metal element (Me) having an electronegativity of 1.3 or less, and the abundance proportion of each element is calculated from the total of the measured abundance ratios (atom %) of each element.

In a case where there are plural of metal elements having an electronegativity of 1.3 or less, Me-P has an abundance proportion calculated by using the sum of plural detected peak intensities.

Isolation Ratio

In this exemplary embodiment, an isolation proportion of the specific strontium titanate particle from the toner particle is preferably 30% or less and more preferably 15% or less, for example.

In a case where the isolation proportion is 30% or less, an amount of the specific strontium titanate particle interposed between the toner particles becomes sufficient, and thus the electrostatic aggregation between the toner particles are easily performed.

This isolation proportion means a proportion (%) of the specific strontium titanate particle isolated from the toner particle with respect to the sum of the specific strontium titanate particle included in the toner in a case where ultrasonic vibration is performed.

The method of measuring an isolation proportion of an external additive in the toner is as below.

First, 100 ml of ion-exchanged water and 5.5 ml of a 10 mass % TRITON X 100 aqueous solution (manufactured by Acros Organics B.V.B.A.) are added to a 200 ml glass bottle, 5 g of the toner is added to the mixed liquid, and the mixture is stirred for 30 times and left for one hour.

Thereafter, the mixed liquid is stirred 20 times, a dial was set to 30% output by using an ultrasonic homogenizer (manufactured by SONICS & MATERIALS, Inc., trade name: homogenizer, model VCX750, CV33), and ultrasonic energy is applied for one minute.

Vibration time: continuously 60 seconds

Amplitude: Set to 20 W (30%)

Vibration start temperature: 23±1.5° C.

Distance between ultrasonic transducer and bottom surface of container: 10 mm

Subsequently, the mixed solution to which ultrasonic energy is applied is subjected to suction filtration [trade name: qualitative filter paper (No. 2, 110 mm), manufactured by Advantec Toyo Kaisha Ltd.], washing is performed again with ion exchanged water twice, the isolated external additive is removed by filtration, and the toner is dried.

After the isolated external additive is removed by the treatment, an amount of the external additive retained in the toner (hereinafter, referred to as an "external additive amount after dispersion") and an amount of the external additive of the toner that is not subjected to the treatment for removing the external additive (hereinafter referred to as an "external additive amount before dispersion") are determined by an X-ray fluorescence element analysis method (XRF), and a value of the external additive amount before dispersion and a value of the external additive amount after dispersion are substituted into an equation below.

The value calculated from the equation is set as an isolation proportion of the external additive.

Isolation proportion of external additive (%)=[(external additive amount before dispersion−external additive amount after dispersion)/external additive amount before dispersion]×100

In a case where the isolation proportion of the specific strontium titanate particle is measured, in a case where an amount is determined by the X-ray fluorescence element analysis method (XRF), and the amount of the specific strontium titanate particle before dispersion and the amount of the specific strontium titanate particle after dispersion are obtained by employing only peak intensities of Sr or Ti. The isolation proportion of the specific strontium titanate particle is calculated by substituting these values into the equation.

The X-ray fluorescence element analysis method (XRF) used in a case of measuring of the isolation proportion is the same as the method used in a case of obtaining Me-R, Sr—R, and Si—R.

The isolation proportion of the specific strontium titanate particle from the toner particle may be controlled by a shape and a particle diameter of the specific strontium titanate particle, a shape and a particle diameter of the toner particle, and the mixture condition in a case of externally adding the specific strontium titanate particle to the toner particle.

Specific Strontium Titanate Particle

The strontium titanate particle included as the external additive in the toner of this exemplary embodiment is specifically described.

The specific strontium titanate particle is a strontium titanate particle doped with a metal element (dopant) having an electronegativity of 1.3 or less.

In a case where the specific strontium titanate particle includes a metal element having an electronegativity of 1.3 or less as the metal element other than titanium and strontium, as a dopant, the electrostatic aggregation between the toner particles are suppressed, and thus the generation of the color point may be suppressed.

The dopant used in the specific strontium titanate particle is not particularly limited, as long as the dopant is a metal element other than titanium and strontium and is a metal element having an electronegativity of 1.3 or less. The electronegativity in this exemplary embodiment is Allred-Rochow electronegativity.

The metal element that is, for example, preferable as a dopant is provided below together with the electronegativity of Allred-Rochow. Specifically, in addition to magnesium (1.23), calcium (1.04), yttrium (1.11), zirconium (1.22), niobium (1.23), barium (0.97), examples thereof include lanthanoid such as lanthanum (1.08) and cerium (1.06).

It is assumed that, in a case where lanthanoid is used as a dopant, lanthanoid stably releases trivalent electrons, and thus it is possible to obtain specific strontium titanate particles in which the charge bias on the surface of the strontium titanate particles is easily suppressed, and charge uniformity is high.

Therefore, the dopant is preferably lanthanoid (all having an Allred-Rochow electronegativity of 1.3 or less) and particularly preferably lanthanum (1.08), for example, in view of being easily doped to the specific strontium titanate particle and having a low electronegativity.

With respect to the amount of the dopant in the specific strontium titanate particle, in view of suppressing the electrostatic aggregation between the toner particles, a dopant with respect to strontium is preferably in the range of 0.1 mol % or more and 20 mol % or less, more preferably in the range of 0.1 mol % or more and 15 mol % or less, and even more preferably 0.1 mol % or more and 10 mol % or less, for example.

In view of easily suppressing the electrostatic aggregation between the toner particles, the content of the dopant in the specific strontium titanate particle is preferably in the range of 0.1 mass % or more and 10 mass % or less, more preferably 0.2 mass % or more and 8.5 mass % or less, and even more preferably in the range of 0.4 mass % or more and 4.1 mass % or less, for example.

Here, the content of the dopant in the specific strontium titanate particle is obtained by the X-ray fluorescence element analysis method (XRF). In the X-ray fluorescence element analysis method (XRF), a method such as a method of substituting the measurement sample to the specific strontium titanate particle and measuring detected peak intensity (Me-R) of a metal element having an electronegativity of 1.3 or less is employed.

Hydrophobized Surface

In view of improving the action of the specific strontium titanate particle, the specific strontium titanate particle preferably has a hydrophobized surface, for example. That is, although not particularly limited, the specific strontium titanate particle is preferably obtained by hydrophobizing a surface of the (untreated) strontium titanate particle.

Among these, in view of easily hydrophobizing a surface, it is preferable to have a hydrophobized surface in a silicon-containing organic compound, for example. Examples of the silicon-containing organic compound include an alkoxysilane compound, a silazane compound, and silicone oil. Among these, at least one selected from an alkoxysilane compound and silicone oil is preferable, for example.

The silicon-containing organic compound is specifically described in the section of the method of manufacturing the strontium titanate particle.

The specific strontium titanate particle preferably has a surface (that is, a hydrophobized surface) including 5 mass % or more and 30 mass % or less of a silicon-containing organic compound with respect to a mass of the strontium titanate particle, for example.

That is, the hydrophobic treatment amount by the silicon-containing organic compound is preferably 1 mass % or more and 50 mass % or less, more preferably 5 mass % or more and 40 mass % or less, and even more preferably 5 mass % or more and 30 mass % or less with respect to the mass of the strontium titanate particle, for example.

Average Primary Particle Diameter

In view of improving dispersibility and coverage with respect to toner particles and in view of easily controlling an isolation proportion to toner particles within the range, the specific strontium titanate particle has an average primary particle diameter of 10 nm or more and 100 nm or less, more preferably 20 nm or more and 80 nm or less, even more preferably 20 nm or more and 60 nm or less, and even more preferably 30 nm or more and 60 nm or less, for example.

The primary particle diameter of specific strontium titanate particle in this exemplary embodiment is the diameter (so-called circle equivalent diameter) of a circle having an area the same as the primary particle image, and the average primary particle diameter of specific strontium titanate particles is a particle diameter which becomes 50% of accumulation from the small diameter side in the distribution of primary particle diameters based on the number.

The average primary particle diameter of the specific strontium titanate particle is measured, for example, by a method below.

First, observation is performed with a scanning electron microscope (SEM) at a magnification of 40,000 times, and 300 primary particles of strontium titanate particles are randomly specified from one visual field. The equivalent circle diameter of each of 300 primary particles is obtained by the image analysis using the specified strontium titanate particles with image analysis software.

The circle equivalent diameter which becomes 50% of the accumulation from the small diameter side in the number-based distribution of 300 primary particles is obtained.

Here, S-4800 manufactured by Hitachi High-Technologies Corporation is used as a scanning electron microscope, and measurement conditions are an acceleration voltage of 15 kV, an emission current of 20 μA, and a WD of 15 mm. As image analysis software, the image processing analysis software WinRoof (Mitani Corporation) is used.

The average primary particle diameter of the specific strontium titanate particle may be controlled, for example, by various conditions in a case where the strontium titanate particle is manufactured by a wet process.

Method of Manufacturing Specific Strontium Titanate Particle

The strontium titanate particle is manufactured by hydrophobizing the surface after the manufacturing of the strontium titanate particle, if necessary.

The method of manufacturing the strontium titanate particle is not particularly limited, but is preferably a wet process in view of controlling a particle diameter and a shape.

Manufacturing Strontium Titanate Particle

The wet process of the strontium titanate particle is a manufacturing method of performing reaction while an aqueous alkaline solution is added to a mixed solution of a titanium oxide source and a strontium source and then performing an acid treatment. In this manufacturing method, the particle diameter of the strontium titanate particles is controlled by a mixing ratio of the titanium oxide source and the strontium source, a concentration of the titanium oxide source at the initial stage of the reaction, the temperature and the addition rate at the time of adding the aqueous alkaline solution, and the like.

As a titanium oxide source, although not particularly limited, a mineral acid peptized product of a hydrolyzate of a titanium compound is preferable. Examples of the strontium source include strontium nitrate and strontium chloride.

The mixing ratio of the titanium oxide source and the strontium source is preferably 0.9 or more and 1.4 or less and more preferably 1.05 or more and 1.20 or less in a molar ratio of $SrO/TiO_2$, for example. The concentration of the titanium oxide source in the initial stage of the reaction is preferably 0.05 mol/L or more and 1.3 mol/L or less and more preferably 0.5 mol/L or more and 1.0 mol/L or less as $TiO_2$, for example.

In order to satisfy Conditions (1) and (4), with respect to the strontium titanate particles, a dopant source is added to a mixed solution of a titanium oxide source and a strontium source. Examples of the dopant source include an oxide of metal other than titanium and strontium. The metal oxide as the dopant source is added as a solution dissolved in, for example, nitric acid, hydrochloric acid, sulfuric acid, or the like.

The addition amount of the dopant source is preferably an amount in which metal which is a dopant is 0.1 moles or more and 20 moles or less and more preferably an amount in which metal is 0.5 moles or more and 10 moles or less with respect to 100 moles of strontium, for example.

The dopant source may be added in a case where the aqueous alkaline solution is added to the mixed solution of the titanium oxide source and the strontium source. Also in that case, the metal oxide of the dopant source may be added as a solution of being dissolved in nitric acid, hydrochloric acid, or sulfuric acid.

As the aqueous alkaline solution, a sodium hydroxide aqueous solution is preferable, for example. There is a tendency in that, as the temperature at the time of adding the aqueous alkaline solution becomes higher, a strontium titanate particle having more satisfactory crystallinity may be obtained. In this exemplary embodiment, the temperature is preferably in the range of 60° C. or higher and 100° C. or lower, for example.

With respect to the addition rate of the aqueous alkaline solution, as the addition rate is lower, the strontium titanate particle having a larger particle diameter may be obtained, and as the addition rate is higher, the strontium titanate particle having a smaller particle diameter may be obtained. The addition rate of the aqueous alkaline solution, for example, is 0.001 equivalent/h or more and 1.2 equivalent/h or less and appropriately 0.002 equivalent/h or more and 1.1 equivalent/h or less with respect to the introduced raw material.

Hydrophobic Treatment

The hydrophobic treatment performed on the surface of the strontium titanate particle is performed, for example, by preparing a treatment liquid obtained by mixing a hydrophobic treatment agent and a solvent, mixing the strontium titanate particle and the treatment liquid under stirring, and further performing stirring continuously.

After the surface treatment, the drying treatment is performed for the purpose of removing the solvent of the treatment liquid.

Although not particularly limited, the hydrophobic treatment agent is preferably silicon-containing organic compound, and examples of the silicon-containing organic compound include an alkoxysilane compound, a silazane compound, and silicone oil.

Examples of the alkoxysilane compound which is a hydrophobic treatment agent include tetramethoxysilane and tetraethoxysilane; methyltrimethoxysilane, ethyl trimethoxysilane, propyl trimethoxysilane, butyl trimethoxysilane, hexyltrimethoxysilane, n-octyltrimethoxysilane, decyltrimethoxysilane, dodecyltrimethoxysilane, vinyl triethoxysilane, methyltriethoxysilane, ethyltriethoxysilane, butyl triethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, and benzyltriethoxysilane; dimethyl dimethoxysilane, dimethyl diethoxysilane, methyl vinyl dimethoxysilane, methyl vinyl diethoxysilane, diphenyldimethoxysilane, and diphenyldiethoxysilane; trimethylmethoxysilane, and trimethylethoxysilane.

Examples of the silazane compound that is a hydrophobilizing agent include dimethyl disilazane, trimethyldisilazane, tetramethyldisilazane, pentamethyldisilazane, and hexamethyldisilazane.

Examples of the silicone oil which is the hydrophobic treatment agent include silicone oil such as dimethyl polysiloxane, diphenyl polysiloxane, and phenylmethyl polysiloxane; reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane.

As the solvent used for preparing the treatment liquid, for example, an alcohol (for example, methanol, ethanol, propanol, and butanol) is preferable in a case where the silicon-containing organic compound is an alkoxysilane compound or a silazane compound, and hydrocarbon (for example, benzene, toluene, normal hexane, normal heptane, and the like) is preferable in a case where the silicon-containing organic compound is silicone oil.

In the treatment liquid, the concentration of the silicon-containing organic compound is preferably 1 mass % or more and 50 mass % or less, more preferably 5 mass % or more and 40 mass % or less, and even more preferably 10 mass % or more and 30 mass % or less, for example.

The amount of the silicon-containing organic compound used for the surface treatment is preferably 1 part by mass or more and 50 parts by mass or less, more preferably 5 parts by mass or more and 40 parts by mass or less, and even more preferably 5 parts by mass or more and 30 parts by mass or less with respect to 100 parts by mass of the strontium titanate particle, for example.

As above, the strontium titanate particle having the surface subjected to the hydrophobic treatment may be obtained.

External Addition Amount

In view of easily controlling the electrostatic aggregation between the toner particles, the externally added amount of the specific strontium titanate particle is preferably 0.1 parts by mass or more and 3 parts by mass or less, more preferably 0.3 parts by mass or more and 2 parts by mass or less, and even more preferably 0.3 parts by mass or more and 1.5 parts by mass or less with respect to 100 parts by mass of the toner particle, for example.

The toner according to this exemplary embodiment satisfies Conditions (1) to (3). In view of controlling the electrostatic aggregation between the toner particle, a mass ratio (strontium titanate particle/silica particle) between the strontium titanate particle and the silica particle is preferably 0.07 or more and 1.0 or less and more preferably 0.1 or more and 0.5 or less, for example.

Silica Particle

Subsequently, a silica particle used as an external additive in the toner according to this exemplary embodiment is described.

The silica particle as the external additive of the toner according to this exemplary embodiment may be a particle using silica, that is, $SiO_2$ as a major component and may be crystalline or amorphous.

The silica particles may be particles manufactured from a silicon compound such as water glass and alkoxysilane as a raw material and may be particles obtained by pulverizing quartz.

Examples of the silica particle include a sol-gel silica particle, an aqueous colloidal silica particle, an alcoholic silica particle, a fumed silica particle obtained by a vapor phase method, and a melted silica particle.

As the external additive, a silica particle having a different volume average particle diameter may be used. Specifically, for example, at least two kinds of particles of a medium diameter silica particle having a volume average particle diameter of 10 nm or more and 100 nm or less (preferably 20 nm or more and 80 nm or less, for example) and a large diameter silica particle having a volume average particle diameter of 50 nm or more and 250 nm or less (preferably 80 nm or more and 200 nm or less, for example).

A mass ratio (medium diameter silica particle/large diameter silica particle) of a content of the medium diameter silica particle is preferably 0.4 or more and 4.0 or less, more preferably 0.6 or more and 3.5 or less, and even more preferably 0.8 or more and 3.0 or less with respect to the content of the large diameter silica particle, for example.

Although not particularly limited, the surface of the silica particles is preferably subjected to a hydrophobic treatment. For example, the hydrophobic treatment is performed by immersing a silica particle to the hydrophobic treatment agent, or the like. The hydrophobic treatment agent is not particularly limited, but examples thereof include a silane coupling agent, a silicone oil, a titanate coupling agent, and an aluminum coupling agent. These may be used singly or two or more kinds thereof may be used in combination. The amount of the hydrophobic treatment agent is, for example, 1 part by mass or more and 10 parts by mass or less with respect to 100 parts by mass of the silica particle.

The external addition amount of the silica particle is preferably 1 part by mass or more and 6 parts by mass or less, more preferably 2 parts by mass or more and 5 parts by mass or less, and even more preferably 4 parts by mass or more and 5 parts by mass or less with respect to 100 parts by mass of the toner particle, for example.

Particle Other than Strontium Titanate Particle

The toner according to this exemplary embodiment may include a particle other than the strontium titanate and the silica particle.

Examples of the other particles include strontium titanate particles not containing a dopant and other inorganic particles.

Examples of the other inorganic particle include $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O{\cdot}(TiO_2)n$, $Al_2O_3{\cdot}2SiO_2$, $CaCO_3$, $MgCO_3$, $BaSO_4$, and $MgSO_4$.

The surface of the inorganic particle as the external additive may be subjected to the hydrophobic treatment. For example, the hydrophobic treatment is performed by immersing an inorganic particle to the hydrophobic treatment agent, or the like. The hydrophobic treatment agent is not particularly limited, but examples thereof include a silane coupling agent, a silicone oil, a titanate coupling agent, and an aluminum coupling agent. These may be used singly or two or more kinds thereof may be used in combination.

The amount of the hydrophobic treatment agent is generally 1 part by mass or more and 10 parts by mass or less with respect to 100 parts by mass of the inorganic particle.

Examples of the other particle include a resin particle (a resin particle such as polystyrene, polymethyl methacrylate, and melamine resin) and a cleaning activator (for example, a particle of a fluorine-based high molecular weight substance).

In the external additive according to this exemplary embodiment, in a case of including a particle other than the specific strontium titanate particle and the silica particle, the content of the particle other than the specific strontium titanate particle and the silica particle in the entire particle is preferably 5.0 mass % or less, more preferably 0.3 mass % or more and 2.5 mass % or less, and even more preferably 0.3 mass % or more and 2.0 mass % or less, for example.

Toner Particle

Examples of the toner particle include a binder resin and, if necessary, a colorant, a releasing agent, and other additives.

Binder Resin

Examples of the binder resin include a homopolymer of a monomer such as styrenes (for example, styrene, parachlorostyrene, and ∝-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or a vinyl-based resin including a copolymer obtained by combining two or more of these monomers.

Examples of the binder resin include a non-vinyl based resin such as an epoxy resin, a polyester resin, a polyurethane resin, a polyamide resin, a cellulose resin, a polyether resin, and a modified rosin, a mixture of these and the vinyl-based resin, or a graft polymer obtained by polymerizing a vinyl-based monomer in the coexistence thereof.

These binder resins may be used singly or two or more kinds thereof may be used in combination.

As the binder resin, although not particularly limited, a polyester resin is preferable. Examples of the polyester resin include a condensation polymer of polyvalent carboxylic acid and polyhydric alcohol.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acid (such as cyclohexanedicarboxylic acid), aromatic dicarboxylic acid (for example, terephthalic acid, isophthalic acid, phthalic acid, and naphthalene dicarboxylic acid), anhydrides thereof, or lower alkyl ester (for example, having 1 to 5 carbon atoms) thereof. Among these, as the polyvalent carboxylic acid, for example, aromatic dicarboxylic acid is preferable.

As the polyvalent carboxylic acid, trivalent or higher valent carboxylic acid having a crosslinked structure or a branched structure may be used together with the dicarboxylic acid. Examples of the trivalent or higher valent carboxylic acid include trimellitic acid, pyromellitic acid, anhydrides thereof, or lower alkyl esters (for example, having 1 to 5 carbon atoms) thereof.

The polyvalent carboxylic acid may be used singly or two or more kinds thereof may be used in combination.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A and a propylene oxide adduct of bisphenol A). Among these, as the polyhydric alcohol, for example, aromatic diol or alicyclic diol is preferable, and aromatic diol is more preferable.

As the polyhydric alcohol, trihydric or higher hydric polyhydric alcohol having a crosslinked structure or a branched structure may be used together with diol. Examples of trihydric or higher hydric polyhydric alcohol include glycerin, trimethylolpropane, and pentaerythritol.

The polyhydric alcohol may be used singly or two or more kinds thereof may be used in combination.

The glass transition temperature (Tg) of the polyester resin is preferably 50° C. or more and 80° C. or less and more preferably 50° C. or more and 65° C. or less, for example.

The glass transition temperature is calculated from the DSC curve obtained by the differential scanning calorimetry (DSC), more specifically, is obtained from "Extrapolated glass transition onset temperature" disclosed in the method of obtaining the glass of transition temperature of "Method of measuring transition temperature of plastic" of JIS K 7121-1987.

The weight-average molecular weight (Mw) of the polyester resin is preferably 5,000 or more and 1,000,000 or less and more preferably 7,000 or more and 500,000 or less. The number-average molecular weight (Mn) of the polyester resin is preferably 2,000 or more and 100,000 or less, for example. The molecular weight distribution Mw/Mn of the polyester resin is preferably 1.5 or more and 100 or less and more preferably 2 or more and 60 or less, for example.

The weight-average molecular weight and the number-average molecular weight of the polyester resin are measured by gel permeation chromatography (GPC). Measuring of the molecular weight by GPC is performed in a THF solvent by using GPC•HLC-8120 GPC manufactured by Tosoh Corporation as a measuring device and using TSK gel SuperHM-M (15 cm) manufactured by Tosoh Corporation. The weight-average molecular weight and the number-average molecular weight are calculated by using a molecular weight calibration curve prepared from a monodispersed polystyrene standard sample from this measurement result.

The polyester resin may be obtained by the well-known manufacturing method. Specifically, the polyester resin may be obtained, for example, by the method of setting the polymerization temperature to be 180° C. or more and 230° C. or less, depressurizing the inside of the reaction system if necessary, and performing the reaction while removing water and alcohol generated during the condensation.

In a case where the monomer of the raw material does not dissolve or compatibilize at the reaction temperature, a solvent having a high boiling point may be added as a dissolution aid for dissolving. In this case, the polycondensation reaction is performed while the dissolution aid is distilled off. In a case where a monomer with bad compatibility is present, the monomer having bad compatibility and the acid or alcohol to be polycondensed with the monomer may be condensed with each other in advance, so as to be polycondensed with the major component.

The content of the binder resin is preferably 40 mass % or more and 95 mass % or less, more preferably 50 mass % or more and 90 mass % or less, and even more preferably 60 mass % or more and 85 mass % or less with respect to the entire toner particle, for example.

Colorant

Examples of the colorant include pigments such as carbon black, chrome yellow, hansa yellow, benzidine yellow, suren yellow, quinoline yellow, pigment yellow, permanent orange GTR, pyrazolone orange, vulcan orange, watch young red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine-based, xanthene-based, azo-based, benzoquinone-based, azine-based, anthraquinone-based, thioindigo-based, dioxazine-based, thiazine-based, azomethine-based, indico-based, phthalocyanine-based, aniline black-based, polymethine-based, triphenyl methane-based, diphenylmethane-based, and thiazole-based dyes.

The colorant may be used singly or two or more kinds thereof may be used in combination.

As the colorant, if necessary, a surface-treated colorant may be used or a dispersing agent may be used in combination. Plural colorants may be used in combination.

The content of the colorant is preferably 1 mass % or more and 30 mass % or less and more preferably 3 mass % or more and 15 mass % or less with respect to the entire toner particle, for example.

Releasing Agent

Examples of the releasing agent include hydrocarbon wax; natural wax such as carnauba wax, rice wax, and candelilla wax; synthetic or mineral/petroleum wax such as montan wax; and ester type wax such as fatty acid ester and montanic acid ester. The releasing agent is not limited thereto.

The melting temperature of the releasing agent is preferably 50° C. or more and 110° C. or less and more preferably 60° C. or more and 100° C. or less, for example.

The melting temperature is calculated from the DSC curve obtained by the differential scanning calorimetry (DSC) by "Melting peak temperature" disclosed in the method of obtaining the melting temperature of "Method of measuring transition temperature of plastic" of JIS K 7121-1987.

The content of the releasing agent is preferably 1 mass % or more and 20 mass % or less and more preferably 5 mass % or more and 15 mass % or less with respect to the entire toner particle, for example.

Other Additives

Examples of other additives include well-known additives such as a magnetic material, a charge control agent, and an inorganic powder. These additives are included in the toner particle as an internal additive.

Properties of Toner Particle

The toner particle may be a toner particle of a single layer structure or may be a toner particle of a so-called core-shell structure including a core part (core particle) and a coating layer (shell layer) coating the core part. The toner particle of a core-shell structure, for example, includes a core part including a binder resin and, if necessary, a colorant, a releasing agent, and the like, and a coating layer including a binder resin.

The volume average particle diameter (D50v) of the toner particle is preferably 2 μm or more and 10 μm or less and more preferably 4 μm or more and 8 μm or less, for example.

The volume average particle diameter of the toner particle is measured using COULTER MULTISIZER II (manufactured by Beckman Coulter, Inc.) and using ISOTON-II (manufactured by Beckman Coulter, Inc.) as an electrolytic solution.

In the measurement, 0.5 mg or more and 50 mg or less of a measurement sample is added to 2 ml of a 5 mass % aqueous solution of a surfactant (although not particularly limited, preferably sodium alkylbenzenesulfonate) as a dispersing agent. This is added to 100 ml or more and 150 ml or less of the electrolytic solution.

A dispersion treatment of the electrolytic solution in which the sample is suspended was performed for one minute with an ultrasonic disperser, and each of the particle diameters of the particle having a particle diameter in the range of 2 μm to 60 μm is measured by using an aperture of 100 μm by Coulter Multisizer II. The number of sampling particles is 50,000.

With respect to the measured particle diameter, the cumulative volume-based distribution is drawn from the small diameter side, and the particle diameter at which the accumulation becomes 50% is defined as the volume average particle diameter D50v.

A shape factor SF1 of the toner particle is preferably 110 or more and 150 or less and more preferably 120 or more and 140 or less, for example.

The shape factor SF1 is obtained by the following equation.

$$SF1=(ML^2/A)\times(\pi/4)\times 100 \qquad \text{Equation:}$$

In the equation, ML is an absolute maximum length of the toner, and A is the projected area of the toner.

Specifically, the shape factor SF1 is digitized by analyzing a microscopic image or a scanning electron microscope (SEM) image by using an image analyzer and is calculated as follows. That is, an optical microscopic image of particles scattered on the surface of the slide glass is introduced into a RUZEX image analyzer by a video camera, the maximum length and the projected area of 100 particles are obtained and calculated by the above equation, and the average value is calculated so as to obtain the shape factor SF1.

Method of Manufacturing Toner

Subsequently, a method of manufacturing the toner according to this exemplary embodiment is described.

The toner according to this exemplary embodiment may be obtained by externally adding an external additive to the toner particle after the toner particle is manufactured.

The toner particle may be manufactured by any one of a dry process (for example, a kneading pulverization method) and a wet process (for example, an aggregation coalescence method, a suspension polymerization method, and a dissolution suspension method). These processes are not particularly limited, and well-known processes are employed. Among these, toner particles may be obtained by a coagulation coalescence method.

Specifically, for example, in a case where toner particles are manufactured by an aggregation coalescence method, the toner particles are manufactured by the toner particles are manufactured through a step of (a resin particle dispersion preparation step) of preparing a resin particle dispersion in which resin particles to be a binder resin are dispersed, a step of aggregating the resin particles (other particles, if necessary) in the resin particle dispersion (in a dispersion after other particles are mixed, if necessary) to form aggregated particles, and a step (coagulation/coalescence step) of heating the aggregated particle dispersion in which the aggregated particles are dispersed, and coagulating and coalescing the aggregated particles to form toner particles.

Hereinafter, respective steps are described.

In the following description, a method for obtaining toner particles including a colorant and a releasing agent is described, but a colorant and a releasing agent are used, if necessary. It is obvious that, other additives other than the colorant and the releasing agent may be used.

Resin Particle Dispersion Preparation Step

Together with the resin particle dispersion in which resin particles to be a binder resin are dispersed, for example, a colorant particle dispersion in which colorant particles are dispersed and a releasing agent particle dispersion in which releasing agent particles are dispersed are prepared.

The resin particle dispersion is prepared, for example, by dispersing resin particles in a dispersion medium by a surfactant.

Examples of the dispersion medium used for the resin particle dispersion include an aqueous medium.

Examples of the aqueous medium include water such as distilled water and ion exchanged water and alcohols. These may be used singly or two or more kinds thereof may be used in combination.

Examples of the surfactant include an anionic surfactant such as sulfate ester salt-based, sulfonate-based, phosphate ester-based, and soap-based surfactants; a cationic surfactant such as amine salt-based and quaternary ammonium salt-based surfactants; and a nonionic surfactant such as polyethylene glycol-based, alkylphenol ethylene oxide adduct-based, and polyhydric alcohol-based surfactants. Among these, particularly, an anionic surfactant and a cationic surfactant are exemplified. The nonionic surfactant may be used together with an anionic surfactant and a cationic surfactant.

The surfactant may be used singly or two or more kinds thereof may be used in combination.

With respect to the resin particle dispersion, examples of the method of dispersing the resin particles in a dispersion medium, for example, include a general dispersing method such as a rotary shearing type homogenizer, a ball mill, a sand mill, and a dyno mill having a medium. According to the types of the resin particle, the resin particles may be dispersed in the dispersion medium by a phase-transfer emulsification method. The phase-transfer emulsification method is a method of dissolving the resin to be dispersed in a hydrophobic organic solvent in which the resin is soluble and performing phase inversion from W/O to O/W by performing neutralization by adding a base to an organic continuous phase (O phase) and introducing the aqueous medium (W phase), so as to disperse the resin in a particle form in an aqueous medium.

The volume average particle diameter of the resin particle dispersed in the resin particle dispersion is preferably 0.01 μm or more and 1 μm or less, more preferably 0.08 μm or more and 0.8 μm or less, and even more preferably 0.1 μm or more and 0.6 μm or less, for example.

With respect to the volume average particle diameter of the resin particles, the particle diameter which becomes 50% of the accumulation with respect to all the particles is defined as the volume average particle diameter D50v is measured as the volume average particle diameter D50v, by subtracting the cumulative distribution from the small particle diameter side to the volume with respect to the particle size (channel) partitioned by using the particle size distribution obtained by measurement with a laser diffraction type particle size distribution determination device (for example, LA-700, manufactured by Horiba, Ltd.). The volume average particle diameter of the particles in other dispersions is measured in the same manner.

The content of the resin particle of the resin particle dispersion is preferably 5 mass % or more and 50 mass % or less and more preferably 10 mass % or more and 40 mass % or less, for example.

In the same manner as the resin particle dispersion, for example, a colorant particle dispersion and a releasing agent particle dispersion are also prepared. That is, with regard to the volume average particle diameter of the particles in the resin particle dispersion, the dispersion medium, the dispersion method, and the content of the particles, the same is applied to the releasing agent particles dispersed in the colorant particles dispersed in the colorant particle dispersion and the releasing agent particle dispersion.

Aggregated Particle Forming Step

Subsequently, the resin particle dispersion, the colorant particle dispersion, and the releasing agent particle dispersion are mixed. In the mixed dispersion, the resin particles, the colorant particles, and the releasing agent particles are heteroaggregated and aggregated particles including the resin particles, the colorant particles, and the releasing agent particles which has a diameter close to the diameter of the target toner particle are formed.

Specifically, for example, an aggregating agent is added to the mixed dispersion, pH of the mixed dispersion is adjusted to acidity (for example, pH 2 or more and 5 or less), a dispersion stabilizer is added, if necessary, heating is performed to a temperature (specifically, for example, glass transition temperature of resin particles of −30° C. or more and glass transition temperature of −10° C. or less) close to the glass transition temperature of the resin particles, and the particles dispersed in the mixed dispersion are aggregated, so as to form aggregated particles.

In the aggregated particle forming step, for example, heating may be performed after adding an aggregating agent at room temperature (for example, 25° C.) under stirring stirred with a rotary shearing type homogenizer with a rotary shearing type homogenizer, adjusting pH of the mixed dispersion to acidity (for example, pH 2 or more and 5 or less), and adding the dispersion stabilizer, if necessary.

Examples of the aggregating agent include a surfactant having a polarity opposite to that of the surfactant included in the mixed dispersion, inorganic metal salt, and a divalent or higher valent metal complex. In a case where a metal complex is used as the aggregating agent, the amount of the surfactant used is reduced and the chargeability are improved.

Together with the aggregating agent, an additive that forms a complex or a similar bond with a metal ion of the aggregating agent may be used, if necessary. As the additive, a chelating agent may be used.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as polyaluminum chloride, poly aluminum hydroxide, and calcium polysulfide polymer.

As the chelating agent, a water soluble chelating agent may be used. Examples of the chelating agent include oxycarboxylic acid such as tartaric acid, citric acid, and gluconic acid; and aminocarboxylic acid such as iminodiacetic acid (IDA), nitrilotriacetic acid (NTA), and ethylenediaminetetraacetic acid (EDTA).

The addition amount of the chelating agent is preferably 0.01 parts by mass or more and 5.0 parts by mass or less and more preferably 0.1 parts by mass or more and less than 3.0 parts by mass with respect to 100 parts by mass of the resin particle, for example.

Coagulation Coalescence Step

Next, the aggregated particle dispersion in which the aggregated particles are dispersed is heated, for example, to be equal to or higher than the glass transition temperature of the resin particles (for example, higher than the temperature higher than the glass transition temperature of the resin particles by 10° C. to 30° C.), and the aggregated particles are coagulated and coalesced, so as to form the toner particles.

The toner particles may be obtained through the above steps.

The toner particles may be manufactured through a step of obtaining an aggregated particle dispersion in which the aggregated particles are dispersed, further mixing the aggregated particle dispersion and the resin particle dispersion in which the resin particles are dispersed, and aggregating such that the resin particles are further adhered to the surface of the aggregated particles, to form the second aggregated particles and a step of heating the second aggregated particle dispersion in which the second aggregated particles are dispersed, and coagulating and coalescing of the second aggregated particles, to form toner particles having a core-shell structure.

After completion of the coagulation coalescence step, a well-known washing step, a well-known solid-liquid separation step, and a well-known drying step are performed on to the toner particles formed in the solution, so as to obtain toner particles in a dry state. With respect to the washing step, in view of chargeability, displacement washing with ion exchanged water may be sufficiently performed. With respect to the solid-liquid separation step, in view of productivity, suction filtration, pressure filtration, and the like may be performed. With respect to the drying step, in view of productivity, freeze-drying, air stream drying, viscous flow drying, vibrating viscous drying, and the like may be performed.

Then, the toner according to this exemplary embodiment is manufactured, for example, by adding an external additive to the obtained toner particles in a dry state and performing mixing. The mixing may be performed, for example, a V blender, a HENSCHEL MIXER, or a LOEDIGE MIXER. If necessary, coarse particles of the toner may be removed by using a vibration sieving machine, an air sieve separator, or the like.

Electrostatic Charge Image Developer

The electrostatic charge image developer according to this exemplary embodiment at least includes the toner according to this exemplary embodiment. The electrostatic charge image developer according to this exemplary embodiment may be a single component developer including only the toner according to this exemplary embodiment and may be a double component developer obtained by mixing the toner and a carrier.

The carrier is not particularly limited, and examples thereof include well-known carriers. Examples of the carrier include a coated carrier in which the surface of a core formed of magnetic powder is coated with a resin; a magnetic powder dispersed carrier formulated by dispersing in which magnetic powder in a matrix resin; and a resin impregnated carrier in which porous magnetic powder is impregnated with a resin. The magnetic powder dispersion type carrier and the resin impregnated carrier may be a carrier in which constituent particles of the carrier are used as a core, and the surface is coated with a resin.

Examples of the magnetic powder include magnetic metal such as iron, nickel, and cobalt; and magnetic oxides such as ferrite and magnetite.

Examples of the resin for coating and the matrix resin include polyethylene, polypropylene, polystyrene, polyvinyl acetate, polyvinyl alcohol, polyvinyl butyral, PVC, polyvinyl ether, polyvinyl ketone, a vinyl chloride-vinyl acetate copolymer, a styrene-acrylic acid ester copolymer, a straight silicone resin including an organosiloxane bond, or modified products thereof, a fluorine resin, polyester, polycarbonate, a phenol resin, and an epoxy resin. Additives such as conductive particles may be included in the coating resin and the matrix resin. Examples of the conductive particles include particles of metal such as gold, silver, and copper, carbon black, titanium oxide, zinc oxide, tin oxide, barium sulfate, aluminum borate, and potassium titanate.

In order to coat the surface of the core with the resin, a method of applying the coating resin and a coating layer forming solution obtained by dissolving various additives (used, if necessary) in an appropriate solvent, and the like may be exemplified. The solvent is not particularly limited and may be selected considering the kind of resin to be used, coating suitability, and the like. Specific examples of the resin coating method include an immersion method of immersing the core in a coating layer forming solution; a spraying method of spraying a coating layer forming solution to the surface of the core material; a viscous flow bed method of spraying the coating layer forming solution in a state in which the core is suspended by viscous flow air; and a kneader coater method of mixing a core of a carrier and a coating layer forming solution in a kneader coater and then removing the solvent.

The mixing ratio (mass ratio) of the toner and the carrier in the double-component developer is preferably from toner: carrier=1:100 to 30:100 and more preferably from 3:100 to 20:100, for example.

Image Forming Device and Image Forming Method

An image forming device and an image forming method according to this exemplary embodiment are described.

The image forming device according to this exemplary embodiment includes an image holding member, a charging unit that charges a surface of the image holding member, an electrostatic charge image forming unit that forms an electrostatic charge image on the charged surface of the image holding member, an developing unit that accommodates an electrostatic charge image developer and developing an electrostatic charge image formed on the surface of the image holding member by the electrostatic charge image developer as a toner image, a transfer unit that transfers a toner image formed on the surface of the image holding member to a surface of a recording medium, and a fixing unit that fixes the toner image transferred to the surface of the recording medium. As the electrostatic charge image developer, an electrostatic charge image developer according to this exemplary embodiment is applied.

In the image forming device according to this exemplary embodiment, an image forming method (the image forming method according to this exemplary embodiment) including a charging step of charging a surface of the image holding member, an electrostatic charge image forming step of forming an electrostatic charge image on the charged surface of the image holding member, an developing step of developing an electrostatic charge image formed on the surface of the image holding member by the electrostatic charge image developer according to this exemplary embodiment as a toner image, a transfer step of transferring a toner image formed on the surface of the image holding member to a surface of a recording medium, and a fixing step of fixing the toner image transferred to the surface of the recording medium is performed.

With respect to the image forming device according to this exemplary embodiment, well-known image forming devices such as a device in a direct transfer method of directly transferring a toner image formed on a surface of an image holding member to a recording medium; a device in an intermediate transfer method of firstly transferring a toner image formed on a surface of an image holding member to a surface of an intermediate transfer member and secondarily transferring the toner image transferred to the surface of the intermediate transfer member to the surface of the recording medium; a device of including a cleaning unit that cleans the surface of the image holding member after transferring of the toner image and before charging; and a device of including a discharging unit that performs discharging by irradiating the surface of the image holding member with discharging light after the transferring of the toner image and before charging.

In a case where the image forming device according to this exemplary embodiment is a device in the intermediate transferring method, a configuration in which the transfer unit, for example, includes an intermediate transfer member in which a toner image is transferred to a surface, a primary transfer unit that firstly transfers the toner image formed on the surface of the image holding member to a surface of the intermediate transfer member, and a secondary transfer unit that secondarily transfers the toner image transferred to the surface of the intermediate transfer member to a surface of a recording medium is applied.

In the image forming device according to this exemplary embodiment, for example, a portion including a developing unit may be a cartridge structure (process cartridge) that is detachably attached to the image forming device. As the process cartridge, for example, a process cartridge including a developing unit that accommodates an electrostatic charge image developer according to this exemplary embodiment may be used.

Hereinafter, an example of the image forming device according to this exemplary embodiment is described, but this exemplary invention is not limited thereto. In the description below, major portions illustrated in the drawings are described, and explanation of the others is omitted.

FIG. 1 is a schematic view illustrating the image forming device according to this exemplary embodiment.

The image forming device illustrated in FIG. 1 includes first to fourth image forming units 10Y, 10M, 10C, and 10K (image forming units) of an electrophotographic method that output images of respective colors of yellow (Y), magenta (M), cyan (C), and black (K) based on color separated image data. These image forming units (hereinafter, simply referred to as "units") 10Y, 10M, 10C, and 10K are arranged to be parallel by being spaced in a predetermined distance from each other in a horizontal direction. These units 10Y, 10M, 10C, and 10K may be process cartridges that are detachably attached to the image forming device.

An intermediate transfer belt (an example of the intermediate transfer member) 20 is elongated on upper sides of the respective units 10Y, 10M, 10C, and 10K through the respective units. The intermediate transfer belt 20 is installed to wind a drive roller 22 and a support roller 24 that are in contact with an inner surface of the intermediate transfer belt 20 and is caused to drive in a direction from the first unit 10Y toward the fourth unit 10K. The force is applied to the support roller 24 in a direction of departing from the drive roller 22 by a spring or the like, such that tension is applied to the intermediate transfer belt 20. An intermediate transfer belt cleaning device 30 is provided on the image holding surface side of the intermediate transfer belt 20 to face the drive roller 22.

Respective toners of yellow, magenta, cyan, and black that are held in toner cartridges 8Y, 8M, 8C, and 8K are supplied to respective developing devices (an example of developing units) 4Y, 4M, 4C, and 4K of the respective units 10Y, 10M, 10C, and 10K.

The first to fourth units 10Y, 10M, 10C, and 10K have identical configuration and movements, and thus the first unit 10Y that is installed on an upper stream side in the intermediate transfer belt driving direction and forms a yellow image is representatively described.

The first unit 10Y has a photoconductor 1Y that functions as an image holding member. Around the photoconductor 1Y, a charging roller (an example of the charging unit) 2Y that charges a surface of the photoconductor 1Y in a predetermined potential, an exposing device (an example of the electrostatic charge image forming unit) 3 that exposes the charged surface with laser beams 3Y based on a color separated image signal and forms an electrostatic charge image, a developing device (an example of the developing unit) 4Y that supplies a toner charged on an electrostatic charge image and develops an electrostatic charge image, a primary transfer roller (an example of the primary transfer unit) 5Y that transfers the developed toner image on the intermediate transfer belt 20, and a photoconductor cleaning device (an example of the image holding member cleaning unit) 6Y that removes the toner remaining on the surface of the photoconductor 1Y after primary transferring.

The primary transfer roller 5Y is disposed inside the intermediate transfer belt 20 and is provided at a position facing the photoconductor 1Y. Respective bias power supplies (not illustrated) that apply primary transfer bias are connected to the primary transfer rollers 5Y, 5M, 5C, and 5K of the respective units. The respective bias power supplies change the values of the transfer bias applied to the respective primary transfer rollers according to the control of a controller (not illustrated).

Hereinafter, movements for forming a yellow image in the first unit 10Y are described.

First, prior to the movements, the surface of the photoconductor 1Y is charged by the charging roller 2Y to a potential of −600 V to −800 V.

The photoconductor 1Y is formed by laminating a photosensitive layer on a substrate having conductivity (for example, volume resistivity at 20° C. of $1\times10^{-6}$ Ω cm or less). This photosensitive layer is generally high resistance (resistance of general resin), but has properties in which the specific resistance of the portion irradiated with the laser beams changes in a case where the photosensitive layer is irradiated with laser beams. Therefore, the charged surface of the photoconductor 1Y according to image data for yellow sent from the controller (not illustrated) is irradiated with the laser beams 3Y from the exposing device 3. Accordingly, an electrostatic charge image of a yellow image pattern is formed on the surface of the photoconductor 1Y.

The electrostatic charge image is an image formed on the surface of the photoconductor 1Y by charging and is a so-called negative latent image in which the specific resistance of the irradiated portion of the photosensitive layer decreases by the laser beams 3Y such that the charged electric charged on the surface of the photoconductor 1Y flows and charges of the portion not irradiated with the laser beam 3Y are retained.

The electrostatic charge image formed on the photoconductor 1Y rotates to a predetermined developing position according to the driving of the photoconductor 1Y. In this developing position, an electrostatic charge image on the photoconductor 1Y is developed as a toner image and visualized by a developing device 4Y.

The electrostatic charge image developer including at least a yellow toner and a carrier is accommodated in the developing device 4Y. The yellow toner is frictionally electrified by being stirred inside the developing device 4Y, and has charges having the polarity the same (negative polarity) as that of the charges charged on the photoconductor 1Y and is held on a roller (an example of developer holding member). As the surface of the photoconductor 1Y passes through the developing device 4Y, the yellow toner electrostatically adheres to the latent image portion discharged on the surface of the photoconductor 1Y, and the latent image is developed with the yellow toner. The photoconductor 1Y on which the yellow toner image is formed is subsequently moved at a predetermined speed, and the toner image developed on the photoconductor 1Y is transported to a predetermined primary transfer position.

In a case where the yellow toner image on the photoconductor 1Y is transported to the primary transfer position, a primary transfer bias is applied to the primary transfer roller 5Y, the electrostatic force directed from the photoconductor 1Y toward the primary transfer roller 5Y acts on the toner image, and the toner image on the photoconductor 1Y is transferred to the intermediate transfer belt 20. The transfer bias applied at this point has a polarity (+) opposite to the polarity (−) of the toner and is controlled to +10 μA, for example, by the controller (not illustrated) in the first unit 10Y. The toner retained on the photoconductor 1Y is removed by the photoconductor cleaning device 6Y and collected.

The primary transfer bias applied to the primary transfer rollers 5M, 5C, and 5K after the second unit 10M is also controlled in accordance with the first unit.

In this manner, the intermediate transfer belt 20 to which the yellow toner image has been transferred in the first unit 10Y is transported sequentially through the second to fourth units 10M, 10C, and 10K, toner images of respective colors are superimposed and transferred in a multiplex manner.

The intermediate transfer belt 20 on which the four color toner images are transferred in a multiplex manner through the first to fourth units reaches a secondary transfer portion including an intermediate transfer belt 20, the support roller 24 in contact with the inner surface of the intermediate transfer belt, and a secondary transfer roller (an example of the secondary transfer unit) 26 disposed on the image holding surface side of the intermediate transfer belt 20. On the other hand, recording paper (an example of a recording medium) P is fed to the gap between the secondary transfer roller 26 and the intermediate transfer belt 20 via a supply mechanism at a predetermined timing, and the secondary transfer bias is applied to the support roller 24. The transfer bias applied at this point has a polarity (−) of polarity the same as the polarity (−) of the toner, and the electrostatic force directed from the intermediate transfer belt 20 toward the recording paper P acts on the toner image, and the toner image on the intermediate transfer belt 20 is transferred onto the recording paper P. The secondary transfer bias at this point is determined according to the resistance detected by a resistance detection unit (not illustrated) for detecting the resistance of the secondary transfer portion, and the voltage is controlled.

The recording paper P to which the toner image is transferred is sent to a pressure contact portion (nip portion) of a pair of fixing rollers in a fixing device (an example of the fixing unit) 28, a toner image is fixed on the recording paper P, and a fixed image is formed. The recording paper P on which fixing of the color image is completed is exported toward the discharging section, and the series of color image forming movements is ended.

Examples of the recording paper P to which the toner image is transferred include plain paper used for a copying machine or a printer in the electrophotographic method. Examples of the recording medium include an OHP sheet in addition to the recording paper P. In order to further improve the smoothness of the image surface after fixing, although not particularly limited, it is preferable that the surface of the recording paper P is also smooth. For example, coated paper obtained by coating the surface of plain paper with a resin or the like, art paper for printing, and the like may be used.

Process Cartridge and Toner Cartridge

The process cartridge according to this exemplary embodiment is a process cartridge that includes a developing unit accommodating the electrostatic charge image developer according to this exemplary embodiment and developing an electrostatic charge image formed on the surface of the image holding member by the electrostatic charge image developer as the toner image and that is detachably attached to the image forming device.

The process cartridge according to this exemplary embodiment may have a configuration of including a developing unit and, for example, at least one selected from other units such as an image holding member, a charging unit, an electrostatic charge image forming unit, and a transfer unit, if necessary.

Hereinafter, an example of the process cartridge according to this exemplary embodiment is described, but the present invention is not limited thereto. In the description below, major portions illustrated in the drawings are described, and explanation of the others is omitted.

Figure 2:
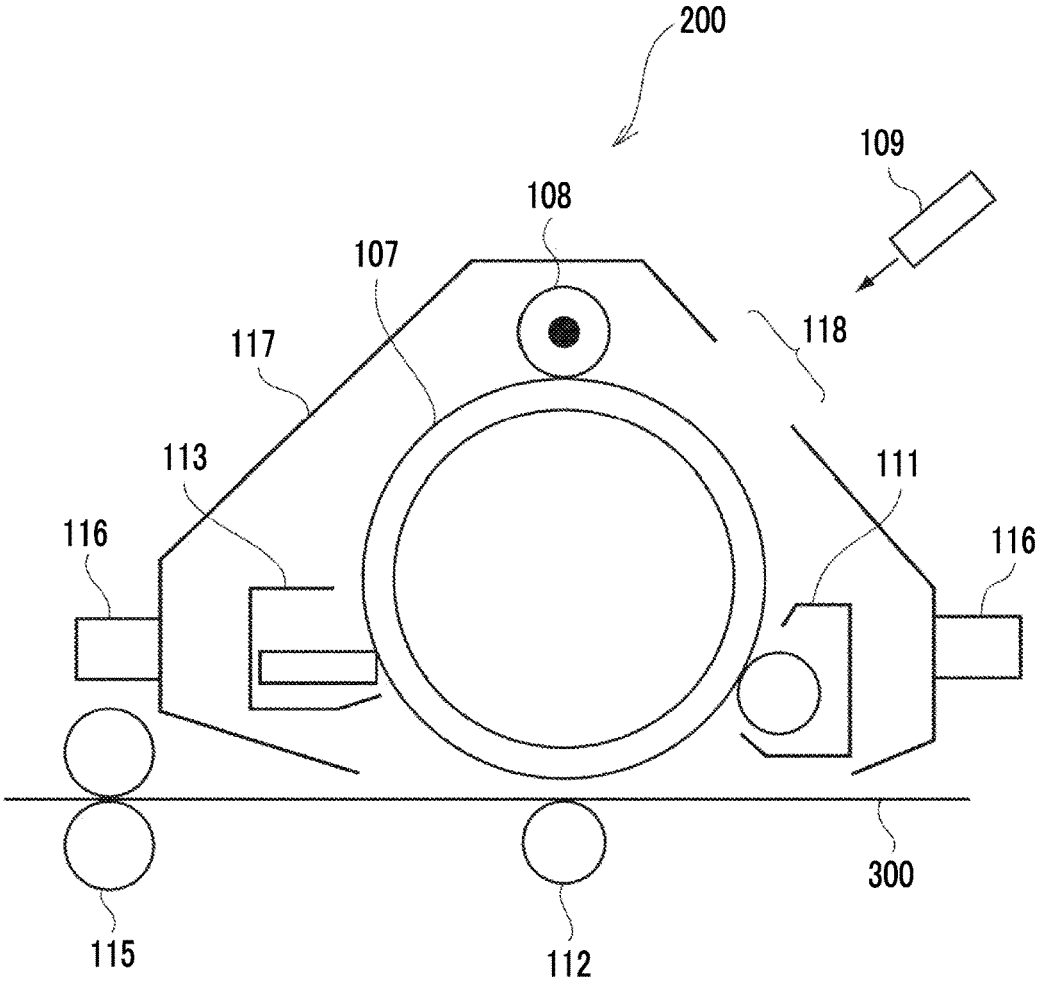
FIG. 2 is a schematic view illustrating a configuration of a process cartridge according to this exemplary embodiment.

FIG. 2 is a schematic view illustrating the process cartridge according to this exemplary embodiment.

A process cartridge 200 illustrated in FIG. 2 became a cartridge combining and holding a photoconductor 107 (an example of the image holding member), a charging roller 108 (an example of the charging unit) around the photoconductor 107, a developing device 111 (an example of the developing unit), and a photoconductor cleaning device 113 (an example of the cleaning unit) in an integrated manner, for example, by a housing 117 including a mounting rail 116 and an opening 118 for exposure.

In FIG. 2, 109 indicates an exposing device (an example of the electrostatic charge image forming unit), 112 indicates a transfer device (an example of the transfer unit), 115 indicates a fixing device (an example of the fixing unit), and 300 indicates a recording paper (an example of the recording medium).

Subsequently, the toner cartridge according to this exemplary embodiment is described.

The toner cartridge according to this exemplary embodiment is a toner cartridge that includes a container that accommodates the toner according to this exemplary embodiment and is detachably attached to the image forming device. The toner cartridge includes the container that accommodates the replenishing toner for being supplied to the developing unit provided in the image forming device.

The image forming device illustrated in FIG. 1 is an image forming device having a configuration in which the toner cartridges 8Y, 8M, 8C, and 8K are detachably attached, and the developing devices 4Y, 4M, 4C, and 4K are connected to the toner cartridges corresponding to the respective colors by toner supply tubes (not illustrated). In a case where the toner that is accommodated in the container in the toner cartridge becomes less, this toner cartridge is replaced.

EXAMPLES

Hereinafter, the exemplary embodiment of the present invention is specifically described with reference to examples, but the present invention is not limited to these examples. Herein, unless otherwise specified, "part" and "%" are based on mass.

Manufacturing of Strontium Titanate Particle

Strontium Titanate Particle (1)

0.7 mol of metatitanic acid which is a desulfurized and deflocculated titanium source as $TiO_2$ is sampled and put into a reaction container. Subsequently, 0.78 mol of a strontium chloride aqueous solution is added to the reaction container such that the $SrO/TiO_2$ molar ratio becomes 1.11. Subsequently, lanthanum nitrate (III) hexahydrate manufactured by Wako Pure Chemical Industries, Ltd. is added to the reaction container in an amount in which lanthanum becomes 5 moles with respect to 100 moles of strontium. The initial concentration of $TiO_2$ in the mixed solution of the three materials is caused to be 0.7 mol/L.

Subsequently, the mixed liquid is stirred and mixed and heated to 90° C., 154 ml of a 10 N sodium hydroxide aqueous solution is added over one hour at 90° C., stirring is further performed at 90° C. for one hour continuously, and the reaction is ended. After the reaction, the slurry is cooled to 40° C., hydrochloric acid is added until pH reaches 5.5, and stirring is performed for one hour. The obtained precipitate is decanted and washed, hydrochloric acid is added to the slurry including the precipitate before filtration and separation, and pH is adjusted to 6.5.

Subsequently, an alcohol solution of i-butyltrimethoxysilane is added to the solid content obtained by solid-liquid separation, in an amount in which i-butyltrimethoxysilane becomes 10 mass % with respect to the solid content, and stirring is performed for one hour.

Then, the obtained cake is dried in the atmosphere at 130° C. for seven hours so as to obtain a strontium titanate particle (1).

Strontium Titanate Particle (2)

A strontium titanate particle (2) is manufactured in the same manner as the strontium titanate particle (1), except for adding lanthanum nitrate (III) hexahydrate manufactured by Wako Pure Chemical Industries, Ltd. in an amount in which lanthanum becomes 10 moles with respect to 100 moles of strontium.

Strontium Titanate Particle (3)

A strontium titanate particle (3) is manufactured in the same manner as the strontium titanate particle (1), except for not adding lanthanum nitrate (III) hexahydrate manufactured by Wako Pure Chemical Industries, Ltd.

Strontium Titanate Particle (4)

A strontium titanate particle (4) is manufactured in the same manner as the strontium titanate particle (1), except for not performing a hydrophobic treatment by i-butyltrimethoxysilane.

Various Measurements

With respect to the obtained strontium titanate particle, an average primary particle diameter and a content (presented as "Content of dopant" in Table 1) of the metal element having an electronegativity 1.3 or less are measured.

These measurements are performed in the measuring methods.

Results of the various measurements are provided in Table 1.

Silica Particle (1)

AEROSIL RY50 (manufactured by Nippon Aerosil Co., Ltd.) having an average primary particle diameter of 40 nm is used as a silica particle (1).

Preparation of Toner Particle

Toner Particle (1)

Preparation of Resin Particle Dispersion (1)

Terephthalic acid: 30 parts by mole

Fumaric acid: 70 parts by mole

Bisphenol A ethylene oxide adduct:
5 parts by mole

Bisphenol A propylene oxide adduct:
95 parts by mol

The above materials are introduced to a flask equipped with a stirrer, a nitrogen introduction pipe, a temperature sensor, and a rectification column, the temperature is raised to 220° C. over one hour, and 1 part of titanium tetraethoxide is added to 100 parts of the material is introduced. While generated water is distilled off, the temperature is raised to 230° C. over 30 minutes, the dehydration condensation reaction is continued for one hour at the temperature, and the reaction product is cooled. In this manner, a polyester resin having a weight-average molecular weight of 18,000 and a glass transition temperature of 60° C. is obtained.

40 parts of ethyl acetate and 25 parts of 2-butanol are introduced into a container equipped with a temperature regulating unit and a nitrogen replacing unit to obtain a mixed solvent, 100 parts of a polyester resin is gradually added and dissolved, and 10 mass % of an ammonia aqueous solution (equivalent to 3 times by the molar ratio with respect to the acid value of the resin) are put, and stirring is performed over 30 minutes. Subsequently, the inside of the container is replaced with dry nitrogen, the temperature is maintained at 40° C., and 400 parts of ion exchanged water are added dropwise at a rate of 2 parts/min while the mixed solution is stirred. After the dropwise addition is completed, the temperature is returned to room temperature (20° C. to 25° C.), and bubbling is performed for 48 hours with dry nitrogen while stirring to obtain a resin particle dispersion in which ethyl acetate and 2-butanol are reduced to 1,000 ppm or less. Ion exchanged water is added to the resin particle dispersion, and the solid content is adjusted to 20 mass % so as to obtain a resin particle dispersion (1).

Preparation of Colorant Particle Dispersion (1)

Regal 330 (Carbon black manufactured by Cabot Corporation): 70 parts

Anionic surfactant (NEOGEN RK, manufactured by Daiichi Kogyo Seiyaku Co., Ltd.): 5 parts Ion exchanged water: 200 parts The materials are mixed and dispersed for 10 minutes by using a homogenizer (trade name ULTRA-TURRAX T50 manufactured by IKA-Werke GmbH & Co. KG). Ion exchanged water is added such that the solid content in the dispersion became 20 mass % so as to obtain a colorant particle dispersion (1) in which colorant particles having a volume average particle diameter of 170 nm are dispersed.

Preparation of Releasing Agent Particle Dispersion (1)

Paraffin wax (Nippon Seiro Co., Ltd., HNP-9):
100 parts

Anionic surfactant (NEOGEN RK, manufactured by Daiichi Kogyo Seiyaku Co., Ltd.): 1 part Ion exchanged water: 350 parts The materials are mixed, heated to 100° C., dispersed using a homogenizer (IKA-Werke GmbH & Co. KG, trade name ULTRA-TURRAX T50), and performing a distribution treatment a MANTON GAULIN high pressure homogenizer (Gaulin Co., Ltd.), to obtain a releasing agent particle dispersion (1) (solid content amount: 20 mass %) having a volume average particle diameter of 200 nm.

Manufacturing of Toner Particle (1)

Resin particle dispersion (1): 403 parts

Colorant particle dispersion (1): 12 parts

Releasing agent particle dispersion (1):
50 parts

Anionic surfactant (TaycaPower): 2 parts

The materials are introduced in a round stainless steel flask, 0.1 N nitric acid is added such that pH is adjusted to 3.5, and 30 parts of a nitric acid aqueous solution having a polyaluminum chloride concentration of 10 mass % is added. Subsequently, the mixture is dispersed at a liquid temperature of 30° C. using a homogenizer (IKA-Werke GmbH & Co. KG, trade name ULTRA TURRAX T50), heated to 45° C. in a heating oil bath, and maintained for 30 minutes.

Thereafter, 100 parts of the resin particle dispersion (1) is gradually added and is maintained for one hour, a 0.1 N sodium hydroxide aqueous solution is added such that pH is adjusted to 8.5, heating is performed to 85° C. while stirring is continued, and the mixture is maintained for five hours. Thereafter, the mixture is cooled to 20° C. at a rate of 20° C./min, filtered, sufficiently washed with ion exchanged water, and dried so as to obtain a toner particle (1) having a volume average particle diameter of 6.1 μm.

Manufacturing of Carrier

A carrier is used one manufactured as follows.

Ferrite particle (volume average particle diameter: 50 μm): 100 parts

Toluene: 14 parts

Styrene-methyl methacrylate copolymer: 2 parts (Copolymerization ratio: 15/85)

Carbon black (R330: manufactured by Cabot Corporation): 0.2 parts

First, the components other than ferrite particles are stirred for 10 minutes with a stirrer so as to prepare a dispersed coating liquid, this coating liquid and ferrite particles are introduced to in a vacuum degassing type kneader, and stirred for 30 minutes at 60° C., further deaired by reducing the pressure while heating, and dried so as to obtain the carrier.

Manufacturing Toner and Developer: Example 1

0.30 parts of the strontium titanate particle (1) as an external additive and 4.5 parts of the silica particle (1) are added to 100 parts of the toner particle (1), stirred by a HENSCHEL mixer at a stirring circumferential speed of 30 m/sec for three minutes, so as to obtain an externally added toner.

The obtained externally added toner and a carrier are placed in a V blender at a ratio of toner:carrier=8:100 (mass ratio) and stirred for 20 minutes so as to obtain a developer.

Manufacturing of Toner and Developer: Examples 2 to 6 and Comparative Examples 1 to 2

A toner and a developer are manufactured in the same manner as in Example 1 except for causing kinds and amounts of the strontium titanate particles (presented as "Externally added amount A" in Table 1) to be as presented in Table 1.

Manufacturing Toner and Developer: Example 7

A toner and a developer are prepared in the same manner as in Example 1 except for changing an addition amount of the silica particle (1) to 8.0 parts (presented as "Externally added amount B" in Table 1).

Manufacturing of Toner and Developer: Example 8 and Comparative Example 3

A toner and a developer are prepared in the same manner as in Example 1 except for changing the added amount (externally added amount A) of the strontium titanate particle (1) to an amount presented in Table 1 and changing an addition amount (external addition amount B) of the silica particles (1) to 1.5 parts.

Evaluation

The obtained developers of each example are accommodated in a developing device of a modified machine of an image forming device "ApeosPort-IV C5575 (manufactured by Fuji Xerox Co., Ltd.)" (modified machine with a concentration automatic control sensor disconnected in environmental fluctuation).

An image having an image density Cin 1% is continuously printed on A4 paper by 5,000 sheets in an environment of 10° C. and 15% RH by using a modified machine of this image forming device.

Thereafter, subsequently, an image having an image density Cin 80% is continuously printed on A4 paper by 1,000 sheets in an environment of 30° C. and 85% RH.

Whether color points due to electrostatic aggregation between the toner particles in 1,000 images that are printed last is present are visually checked, and in a case where there are color points, the number of the color points is obtained.

Among the 1,000 sheets printed, the number of sheets with no color point (the number of color points is 0), the number of sheets with the number of color points of 1 or more and 4 or less, the number of sheets with the number of color points of 5 or more and 9 or less, and the number of sheets with the color points of 10 or more are collectively presented in Table 1.

The allowable range is that the number of color points with 1 or more and 4 or less is 5 or less, that the number of color points is 5 or more and 9 or less is 2 or less, and that the number of color points is 10 or more is 0.

TABLE 1

| | Strontium titanate particle | | | | Silica particle | | Externally | | |
|---|---|---|---|---|---|---|---|---|---|
| | No. | Externally added amount A [parts by mass] | Average primary particle diameter [nm] | Content of dopant [mass %] | No. | Externally added amount B [parts by mass] | added amount A/ Externally added amount B | Me—R [kcps] | Sr—P [%] |
| Example 1 | (1) | 0.30 | 50 | 2 | (1) | 4.5 | 0.07 | 0.38 | 0.19 |
| Example 2 | (1) | 0.75 | 50 | 2 | (1) | 4.5 | 0.17 | 0.94 | 0.48 |
| Example 3 | (2) | 0.92 | 52 | 4 | (1) | 4.5 | 0.21 | 2.32 | 0.50 |
| Example 4 | (1) | 1.84 | 50 | 2 | (1) | 4.5 | 0.41 | 2.34 | 1.18 |
| Example 5 | (2) | 2.00 | 52 | 4 | (1) | 4.5 | 0.44 | 5.06 | 1.08 |
| Example 6 | (4) | 0.75 | 50 | 2 | (1) | 4.5 | 0.07 | 0.94 | 0.48 |
| Example 7 | (1) | 0.30 | 50 | 2 | (1) | 8 | 0.04 | 0.38 | 0.19 |
| Example 8 | (1) | 3 | 50 | 2 | (1) | 1.5 | 2 | 3.78 | 1.93 |
| Comparative Example 1 | (3) | 0.30 | 49 | 0 | (1) | 4.5 | 0.07 | 0 | 0.22 |

TABLE 1-continued

| | | | | | | | | | |
|---|---|---|---|---|---|---|---|---|---|
| Comparative Example 2 | (2) | 5 | 52 | 4 | (1) | 4.5 | 1.25 | 12.62 | 3.21 |
| Comparative Example 3 | (1) | 5 | 50 | 2 | (1) | 1.5 | 2.5 | 6.32 | 3.21 |

| | Sr—R/Si—R [—] | Me—P [%] | Isolation ratio [%] | Color point evaluation [number of sheets] 0 | 1 or more and 4 or less | 5 or more and 9 or less | 10 or more | Acceptable range |
|---|---|---|---|---|---|---|---|---|
| Example 1 | 0.65 | 0.09 | 10 | 997 | 2 | 1 | 0 | Within |
| Example 2 | 1.62 | 0.13 | 12 | 998 | 1 | 1 | 0 | Within |
| Example 3 | 1.70 | 0.23 | 9 | 998 | 2 | 0 | 0 | Within |
| Example 4 | 3.99 | 0.23 | 10 | 998 | 1 | 1 | 0 | Within |
| Example 5 | 3.69 | 0.41 | 11 | 996 | 3 | 1 | 0 | Within |
| Example 6 | 1.62 | 0.13 | 12 | 998 | 2 | 0 | 0 | Within |
| Example 7 | 0.39 | 0.09 | 10 | 995 | 3 | 2 | 0 | Within |
| Example 8 | 9.73 | 0.32 | 11 | 995 | 4 | 1 | 0 | Within |
| Comparative Example 1 | 0.55 | 0.07 | 10 | 950 | 40 | 2 | 8 | Out of |
| Comparative Example 2 | 8.33 | 0.49 | 15 | 985 | 5 | 10 | 0 | Out of |
| Comparative Example 3 | 16 | 0.49 | 12 | 998 | 0 | 0 | 2 | Out of |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle;

a strontium titanate particle that is externally added to the toner particle and that is doped with a metal element having an electronegativity of 1.3 or less; and a silica particle that is externally added to the toner particle, wherein, the silica particle is a particle having a volume average particle diameter of 50 nm or more and 250 nm or less, a detected peak intensity of the metal element which is obtained by an X-ray fluorescence element analysis method is Me-R, a detected peak intensity of strontium which is obtained by an X-ray fluorescence element analysis method is Sr—R, a detected peak intensity of silicon which is obtained by an X-ray fluorescence element analysis method is Si—R, and an element proportion of strontium obtained by an X-ray photoelectron spectroscopy method is Sr—P, in the X-ray fluorescence element analysis method, an amount of elements which are present inside and on the surface of the toner obtained by externally adding an external additive to the toner particles is determined, and Conditions (1) to (3) are satisfied, $$0.08\ \text{kcps} \leq \text{Me-R} \leq 10\ \text{kcps}, \quad (1)$$

$$0.1\% \leq \text{Sr—P} \leq 3.0\%, \text{ and} \quad (2)$$

$$0.15 \leq \text{Sr—R/Si—R} \leq 12. \quad (3)$$

2. The electrostatic charge image developing toner according to claim 1, wherein, an element proportion of the metal element having an electronegativity of 1.3 or less which is obtained by an X-ray photoelectron spectroscopy method is Me-P, and Condition (4) is satisfied, $$0.04\% \leq \text{Me-P} \leq 0.7\%. \quad (4)$$

3. The electrostatic charge image developing toner according to claim 2, wherein, an element proportion of the metal element having an electronegativity of 1.3 or less which is obtained by an X-ray photoelectron spectroscopy method is Me-P, and Condition (4-1)is satisfied, $$0.07\% \leq \text{Me-P} \leq 0.35\%. \quad (4\text{-}1)$$

4. The electrostatic charge image developing toner according to claim 1, wherein an isolation proportion of the strontium titanate particle from the toner particle is 30% or less.

5. The electrostatic charge image developing toner according to claim 4, wherein an isolation proportion of the strontium titanate particle from the toner particle is 15% or less.

6. The electrostatic charge image developing toner according to claim 1, wherein a content of the metal element having an electronegativity of 1.3 or less in the strontium titanate particle is 0.1 mass % or more and 10 mass % or less.

7. The electrostatic charge image developing toner according to claim 6, wherein a content of the metal element having an electronegativity of 1.3 or less in the strontium titanate particle is 0.20 mass % or more and 8.50 mass % or less.

8. The electrostatic charge image developing toner according to claim 1, wherein the strontium titanate particle has a hydrophobized surface.

9. The electrostatic charge image developing toner according to claim 8, wherein the strontium titanate particle has a hydrophobized surface in a silicon-containing organic compound.

10. The electrostatic charge image developing toner according to claim 9, wherein the strontium titanate particle has 5 mass % or more and 30 mass % or less of a silicon-containing organic compound with respect to a mass of the strontium titanate particle on the surface.

11. The electrostatic charge image developing toner according to claim 1, wherein the metal element having an electronegativity of 1.3 or less in the strontium titanate particle is lanthanum.

12. The electrostatic charge image developing toner according to claim 1, wherein an average primary particle diameter of the strontium titanate particle is 10 nm or more and 100 nm or less.

13. The electrostatic charge image developing toner according to claim 12, wherein an average primary particle diameter of the strontium titanate particle is 20 nm or more and 60 nm or less.

14. The electrostatic charge image developing toner according to claim 1, wherein a mass ratio (strontium titanate particle/silica particle) of the strontium titanate particle and the silica particle is 0.07 or more and 1.00 or less.

15. The electrostatic charge image developing toner according to claim 14, wherein a mass ratio (strontium titanate particle/silica particle) of the strontium titanate particle and the silica particle is 0.10 or more and 0.4 or less.

16. The electrostatic charge image developing toner according to claim 1, wherein Me-R, Sr—R, Si—R, and Sr—P satisfy Conditions (1-1) to (3-1), $$0.12 \text{ kcps} \leq \text{Me-R} \leq 4 \text{ kcps}, \quad (1\text{-}1)$$

$$0.3\% \leq \text{Sr—P} \leq 1.0\%, \text{ and} \quad (2\text{-}1)$$

$$0.4 \ \text{Sr—R/Si—R} \leq 5. \quad (3\text{-}1)$$

17. An electrostatic charge image developer comprising:

the electrostatic charge image developing toner according to claim 1.

18. A toner cartridge comprising:

a container that contains the electrostatic charge image developing toner according to claim 1, wherein the toner cartridge is detachably attached to an image forming device.

* * * * *